US007414501B2

(12) United States Patent
Imanishi et al.

(10) Patent No.: US 7,414,501 B2
(45) Date of Patent: Aug. 19, 2008

(54) ELECTROMAGNETIC SWITCH FOR STARTER

(75) Inventors: Tomoya Imanishi, Kariya (JP); Youichi Hasegawa, Kasugai (JP); Sadayoshi Kajino, Nagoya (JP)

(73) Assignee: Denso Corporation, Kariya (JP)

( * ) Notice: Subject to any disclaimer, the term of this patent is extended or adjusted under 35 U.S.C. 154(b) by 157 days.

(21) Appl. No.: 11/228,297

(22) Filed: Sep. 19, 2005

(65) Prior Publication Data

US 2006/0135002 A1 Jun. 22, 2006

(30) Foreign Application Priority Data

Dec. 20, 2004 (JP) ..... 2004-368354

(51) Int. Cl.
*H01H 67/02* (2006.01)

(52) U.S. Cl. ..... 335/132; 439/801

(58) Field of Classification Search ..... 335/172, 335/132

See application file for complete search history.

(56) References Cited

U.S. PATENT DOCUMENTS 6,234,850 B1 * 5/2001 Pandit et al. ..... 439/801
6,762,663 B2 7/2004 Andoh et al.
2004/0169573 A1 9/2004 Andoh et al.

FOREIGN PATENT DOCUMENTS

JP A 2004-111231 4/2004

* cited by examiner

*Primary Examiner*—Elvin Enad
*Assistant Examiner*—Joselito Baisa
(74) *Attorney, Agent, or Firm*—Oliff & Berridge, PLC

(57) ABSTRACT

An electromagnetic switch mounted on a starter for cranking an internal combustion engine includes an excitation coil for driving a plunger upon supplying electric current to the excitation coil. A conductor member led out from the excitation coil is connected to an outside cable to supply electric current to the excitation coil. The conductor member is made of a thin plate to be easily led out from a molded contact cover and is connected to a reinforcing member made of a thick plate that is embedded in the contact cover. The outside cable is connected to the reinforcing member so that the thin conductor member is not damages by a high vibration of an engine. The outside cable is easily connected to the reinforcing member with a screw after completion of the electromagnetic switch.

7 Claims, 3 Drawing Sheets

ELECTROMAGNETIC SWITCH FOR STARTER

CROSS-REFERENCE TO RELATED APPLICATION

This application is based upon and claims benefit of priority of Japanese Patent Application No. 2004-368354 filed on Dec. 20, 2004, the content of which is incorporated herein by reference.

BACKGROUND OF THE INVENTION

1. Field of the Invention

The present invention relates to an electromagnetic switch to be mounted on a starter for cranking an internal combustion engine, and more particularly to a structure for leading out a conductor member in the electromagnetic switch.

2. Description of Related Art

An electromagnetic switch to be mounted on a starter for cranking an internal combustion engine usually includes a plunger driven by an excitation coil and a movable contact moving in an axial direction of the plunger according to movement of the plunger. Electric current is supplied to the excitation coil from an on-board battery through a conductor member connected to the excitation coil. The conductor member is led out through a molded contact cover and extends outside to be connected to an outside cable connected to the battery through an ignition switch. It is required to connect the conductor member to the outside cable by a screw-fastening or welding without using solder-connection in order to withstand a high vibration transferred from an automotive vehicle. At the same time, the conductor member has to be easily led out from the contact cover in an automated manufacturing process.

To meet these requirements, an electromagnetic switch is proposed in JP-A-2002-313205. In this electromagnetic switch, a lead terminal having a high mechanical strength is used in place of a fragile conductor member for supplying excitation current. Since the lead terminal is led out straight in the axial direction through the contact cover, the electromagnetic switch can be assembled in an automated manufacturing line. In the proposed electromagnetic switch, however, a large connecting portion for electrically connecting the lead terminal to the outside cable cannot be provided at an end of the lead terminal, because the lead terminal has to be led out through a through-hole formed in the contact cover. It is, of course, possible to connect a large connecting portion having a female screw hole to the end of the lead terminal by welding after the process of assembling the switch is completed. However, this requires an additional step in the manufacturing process.

Further, to give a sufficient mechanical strength to the lead terminal against high vibration, it is necessary to use a bulky lead terminal which requires enlargement of the contact cover in size. A portion of the lead terminal led out from the contact cover vibrates in a manner of a cantilever supported at a point leading out the lead terminal. Therefore, the size of the lead terminal cannot be made unreasonably large. Further, if the lead terminal is vibrated due to vibration of the outside cable, there is a possibility that the lead terminal may be disconnected.

Another conductor member structure of the electromagnetic switch is proposed in JP-A-2004-111231. In this structure, an end of the outside cable is connected to a molded cover via an eyelet terminal. If a large stress is imposed on the eyelet terminal, there is a possibility that connection of the eyelet terminal to the molded cover is loosened and a conductor member connected to the excitation coil may be disconnected due to vibration transferred from an engine.

SUMMARY OF THE INVENTION

The present invention has been made in view of the above-mentioned problems, and an object of the present invention is to provide an improved electromagnetic switch for a starter, in which a conductor member structure that is durable against a high vibration and is easily manufactured is employed.

The electromagnetic switch is mounted on a starter for cranking an internal combustion engine. The electromagnetic switch closes or opens a main switch for an electric motor and drives a pinion gear of the starter according to operation of an ignition switch. The electromagnetic switch comprises a excitation coil for driving a plunger, a movable contact connected to the plunger, a pair of stationary contacts facing the movable contact, and a contact cover containing the pair of stationary contacts therein. Upon supplying electric current to the excitation coil, the pair of stationary contacts are closed by the movable contact driven by the plunger.

A conductor member to be connected to an outside cable for supplying electric current to the excitation coil is led out through the contact cover in the axial direction of the electromagnetic switch. A reinforcing member having a much higher mechanical strength than the conductor member is embedded in the molded contact cover, and a free end portion of the reinforcing member extends from the contact cover in the axial direction. The extending end of the conductor member is electrically and mechanically connected to the free end portion of the reinforcing member. The free end portion of the reinforcing member is connected to the outside cable. The conductor member is made of a thin metal plate, while the reinforcing member is made of a thick metal plate. The surfaces of the extending end and the free end portion, contacting each other, are rectangular and have a substantially same area to minimize a contact resistance.

The extending end of the conductor member may be connected to the free end portion of the reinforcing member with a screw, and the free end portion may be connected to the outside cable with another screw. Alternatively, the free end portion may be connected to the extending end and to the outside cable with a single screw. The extending end may be connected to the free end portion via a connecting member that is formed separately from the reinforcing member and the conductor member. A pair of walls may be formed at both sides of the edges of the plate-shaped free end portion to prevent the outside cable from rotating around the screw fastening together the free end portion and the outside cable.

According to the present invention, the conductor member made of a thin plate are reinforced by the reinforcing member, and therefore the read wire is able to withstand high vibration transferred from an engine. Since the conductor member is thin and extends from the excitation coil straight in the axial direction, the conductor member can be easily led out from the contact cover in an automated assembling process. The outside cable can be easily connected to the conductor member after the electromagnetic switch is fully completed.

Other objects and features of the present invention will become more readily apparent from a better understanding of the preferred embodiment described below with reference to the following drawings.

DETAILED DESCRIPTION OF THE PREFERRED EMBODIMENT

Figure 1:
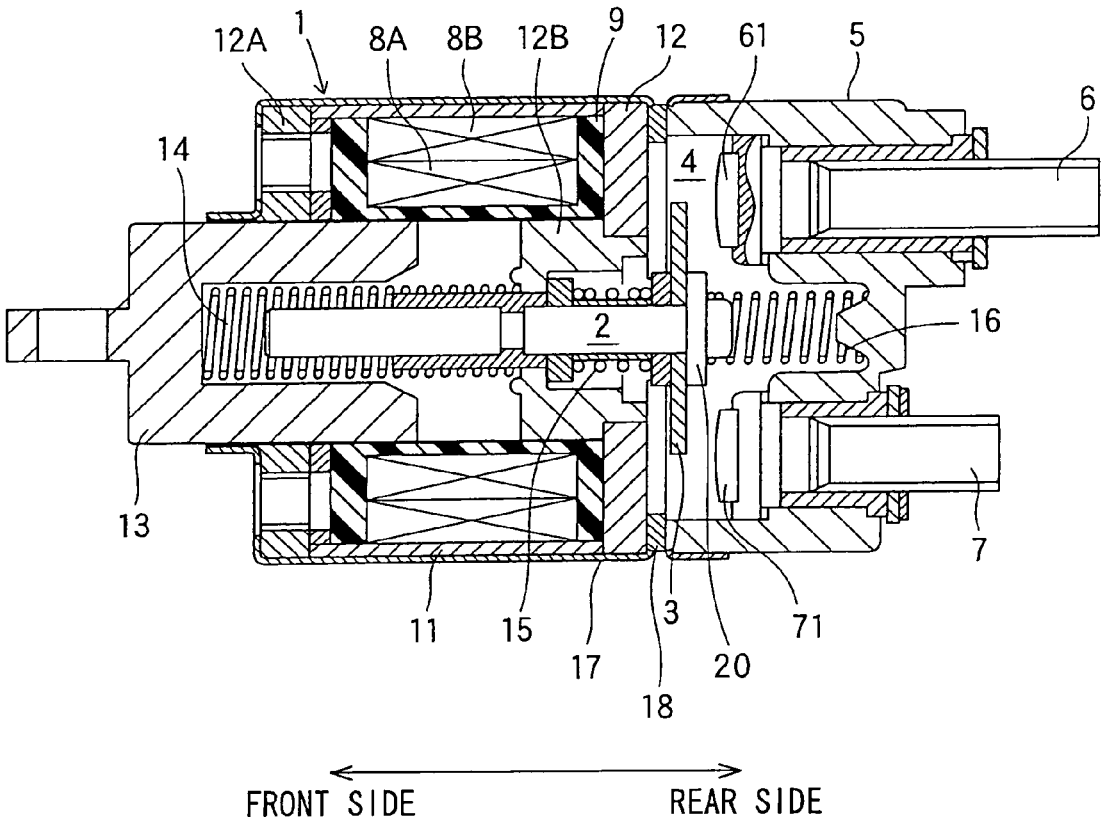
FIG. 1 is a cross-sectional view showing an electromagnetic switch for a starter.
Figure 2:
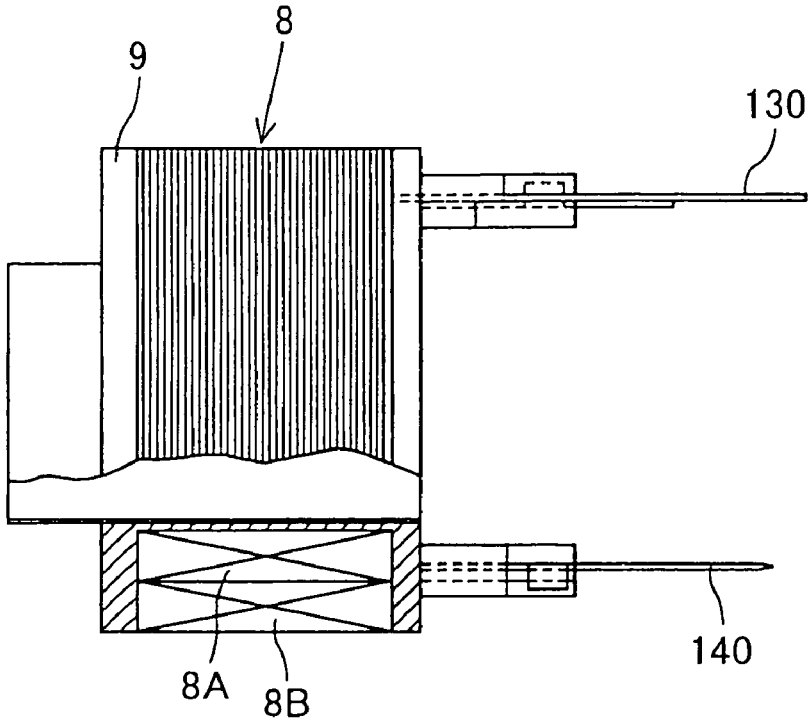
FIG. 2 is a side view, partially cross-sectioned, showing an excitation coil having a conductor member extending therefrom.

A preferred embodiment of the present invention will be described with reference to FIGS. 1-3. An electromagnetic switch shown in FIG. 1 is mounted on a starter for cranking an internal combustion engine and operates as a switch for turning on and off current supply to an electric motor in the starter and as a driver for shifting a pinion gear toward a ring gear of the engine. As long as these fundamental functions are concerned, the electromagnetic switch according to the present invention is the same as a conventional one. However, a structure for leading out a conductor member for supplying electric current to an excitation coil is improved according to the present invention.

First, referring to FIG. 1, an entire structure of the electromagnetic switch will be described. A front side and a rear side along the axial direction are indicated in FIG. 1 for a purpose of convenience of description. At the front side, a main body 1 having a device for driving a plunger 13 and movable contact 3 is located. At the rear side, a contact cover 5 having a pair of stationary contact terminals is located. The main body 1 and the contact cover 5 are firmly connected to each other, forming a unitary electromagnetic switch.

The main body 1 is composed of a stationary magnetic circuit including an excitation coil 8, a plunger 13 functioning as a movable magnetic core, a return spring 14 biasing the plunger toward the front side, a plunger shaft 2 having a movable contact 3, and other associated components. The excitation coil 8 having a driving coil 8A and a holding coil BB is wound on a bobbin 9. The driving coil 8A is wound directly on the bobbin 9, and the holding coil 8B is wound on the driving coil 8A. A magnetic circuit, through which a magnetic flux generated by the excitation coil 8 flows, is formed by stationary members, i.e., a front plate 12A, a yoke 11, a rear plate 12 and a center core 12B; and a movable member, i.e., the plunger 13. The stationary members are disposed in contact with one another and contained in a cylindrical cover 17 together with the excitation coil 8.

A cylindrical sleeve is disposed in an inner bore of the bobbin 9, and the plunger 13 is slidably disposed in the cylindrical sleeve, forming a magnetic circuit together with the stationary members. A return spring 14 is disposed between the center core 12B and the plunger 13 to bias the plunger 13 toward the front side. A plunger shaft 2 made of a non-magnetic material is disposed in a center hole of the plunger 13 and extends into an inner space 4 of the contact cover 5 through a center opening of the center core 12B.

A movable contact 3 insulated from the plunger shaft 2 is connected to the rear end of the plunger shaft 2 to extend in a direction perpendicular to the plunger shaft 2. The movable contact 3 is biased toward the rear side by a contact spring 15. The plunger shaft 2 is biased toward the front side by a rod spring 16. The movable contact 3 is fixedly connected to the plunger shaft 2, and its movement toward the rear side is stopped by a washer 20 fixed to the plunger shaft 2.

The movable contact 3 faces a pair of stationary contacts 61, 71 disposed in the inner space 4 of the contact cover 5. The stationary contact 61 is held on the front end of the stationary contact terminal 6, while the other stationary contact 71 is held on the front end of the stationary contact terminal 7. Both stationary contact terminals 6, 7 are integrally molded in the contact cover 5. The contact cover 5 is firmly connected to the main body 1 by staking or the like with a seal member 18 interposed therebetween.

Operation of the electromagnetic switch described above will be briefly explained. Electric current is supplied to the excitation coil 8 by turning on an ignition switch (not shown). The plunger 13 is driven toward the rear side against the biasing force of the return spring 14. According to the movement of the plunger 13, the plunger shaft 2 is driven toward the rear side against the biasing force of the rod spring 16. The movable contact 3 contacts the pair of stationary contacts 61, 71. The contact pressure between the movable contact 3 and the stationary contacts 61, 71 is increased by the biasing force of the contact spring 15. The plunger 13 is further driven toward the rear side until it is stopped by abutting with the center core 12B.

Upon establishing the contact between the movable contact 3 and the stationary contacts 61, 71, electric current is supplied to an electric motor of the starter from an on-board battery. The engine is cranked up by a rotational torque of the electric motor. After the engine is cranked up, the current supply to the excitation coil 8 is terminated by turning off the ignition switch. The plunger 13 returns to its original position by the biasing force of the return spring 14. According to the frontward movement of the plunger 13, the movable contact 3 is separated from the stationary contacts 61, 71, terminating power supply to the electric motor.

Now, a structure of a conductor member will be described with reference to FIGS. 2 and 3. As shown in FIG. 2, conductor members 130, 140 for supplying electric current to the excitation coil 8 are led out in the axial direction from the bobbin 9. The conductor members 130, 140 are further extended in the axial direction so that they are led out from the contact cover 5 in the axial direction. The conductor member 130 is connected to an outside cable 110 (refer to FIG. 2) that is connected to the on-board battery through the ignition switch. The other conductor member 140 is connected to one of the stationary contact terminals 6, 7, in the same manner as in a conventional electromagnetic switch. The present invention relates to the structure of the conductor member 130. Therefore, the structure of the conductor member 130 will be described below in detail.

The conductor member 130 is a thin flat plate made of a copper alloy. As shown in FIG. 3, the conductor member 130 extends through a through-hole 160 formed in the contact cover 5. An angle-shaped reinforcing member 150 is partly embedded in the molded contact cover 5. The reinforcing member 150 is a flat plate made of a copper alloy and composed of a foot portion that is embedded in the contact cover 5 and a free end portion extending from the contact cover 5. The reinforcing member 150 is several times thicker than the conductor member 130. The foot portion is in contact with the conductor member 130 in the through-hole 160.

Figure 3:
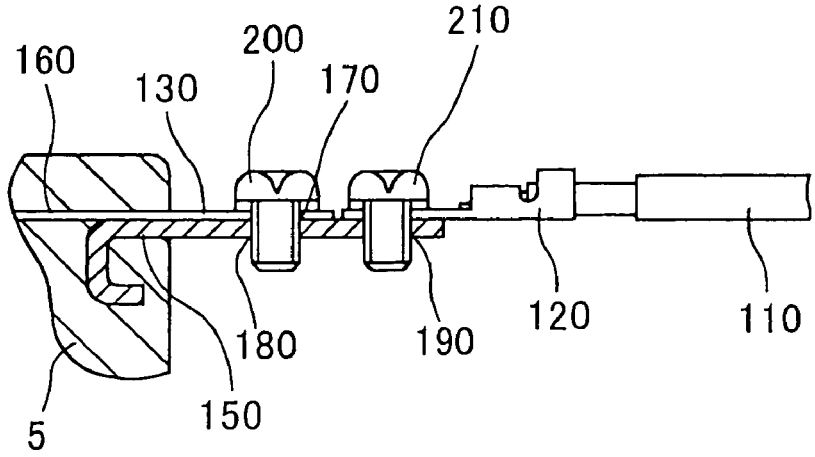
FIG. 3 is a cross-sectional view showing a conductor member structure according to the present invention.

As shown in FIG. 3, one end of the conductor member 130 is extending from the contact cover 5, and the extending end is overlapped with the free end portion of the reinforcing member 150. The surfaces of the extending end and the free end portion contacting each other are referred to as contact surfaces. Both contact surfaces are rectangular and have a substantially same area. The extending end of the conductor member 130 and the free end portion of the reinforcing member 150 are firmly connected to each other by a screw 200 that is screwed in a female screw 180 formed in the reinforcing member 150 through a hole 170 formed in the conductor member 130. The reinforcing member 150 is further connected to a terminal 120 of the outside cable 110 by another screw 210 that is screwed in a female screw 190 formed in the terminal.

The main body 1 and the contact cover 5 are assembled in the following manner. Before assembling, the conductor members 130 and 140 extend from the rear surface of the main body 1 in the axial direction, and the plunger shaft 2 having the movable contact 3 extends in the axial direction from the center of the rear surface of the main body 1. The conductor members 130, 140 are located at positions close to the outer circumference of the main body 1. The conductor members 130, 140 are inserted into the respective through-holes 160 formed in the contact cover 5, and the rear end surface of the main body 1 is pushed against the front end of the contact case 5 with a seal member 18 interposed therebetween. Then, contact cover 5 and the main body 1 are firmly connected to each other by staking or the like. The movable contact 3 faces the pair of stationary contacts 61, 71 with a predetermined distance apart from each other. Then, the conductor member 130 is connected to the reinforcing member 150 by the screw 200. Thus, the contact cover 5 and the main body 1 are assembled, and the electromagnetic switch is completed. The outside cable 110 can be connected to the reinforcing member 150 by the screw 210 at any time after completion of the electromagnetic switch, e.g., even after the starter is mounted on the vehicle.

Figure 4:
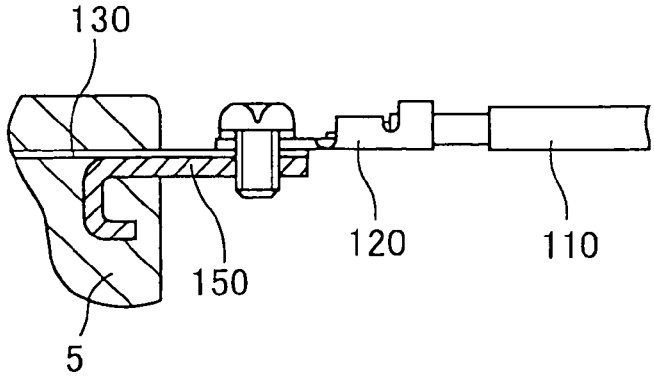
FIG. 4 is a cross-sectional view showing a modified form (1) of the conductor member structure.

The structure of the conductor member 130 may be variously modified. A modified form (1) is shown in FIG. 4. In this modified form (1), the reinforcing member 150 and the terminal 120 of the outside cable 110 are connected by a single screw. It is preferable to slightly incline the reinforcing member 150 toward the conductor member 130 so that both firmly contact to each other by resiliency of the conductor member 130. In this manner, the screw-fastening is easily carried out.

Figure 5:
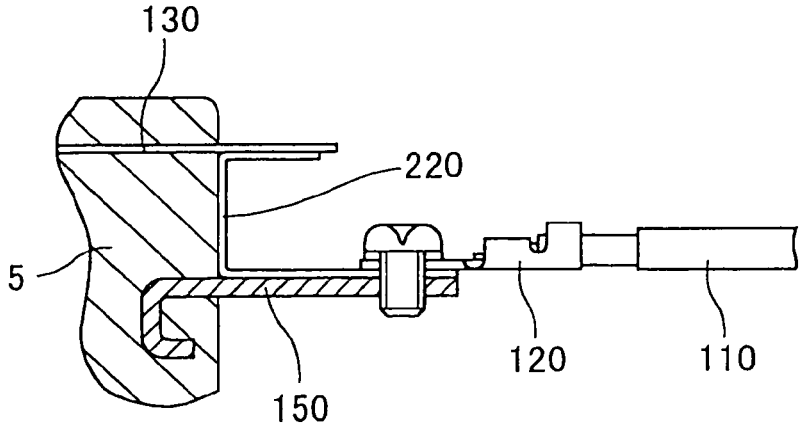
FIG. 5 is a cross-sectional view showing a modified form (2) of the conductor member structure.

A modified form (2) is shown in FIG. 5. In this modified form (2), the conductor member 130 and the reinforcing member 150 are separately positioned and electrically connected to each other via a connecting member 220. The position of embedding the reinforcing member 150 in the contact cover 5 is not limited to a position contacting the through-hole 160. The outside cable 110 is connected to the reinforcing member 150 by a screw. It is preferable to form the connecting member 220 in a U-shape. A center portion of the U-shaped connecting member 220 may be embedded in the contact cover 5 or disposed in a groove formed on the contact cover 5. In this particular form shown in FIG. 5, one end of the connecting member 220 is welded to the conductor member 130, and the other end thereof is fastened to the reinforcing member 150 by a screw. However, other methods of connection may be employed.

Figure 6:
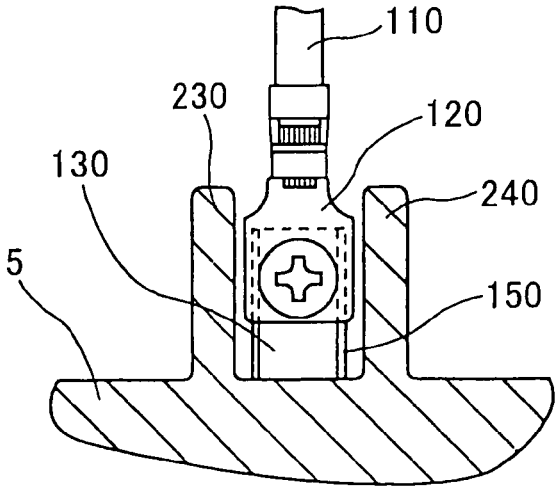
FIG. 6 is a cross-sectional view showing a modified form (3) of the conductor member structure.

A modified form (3) is shown in FIG. 6. In this modified form (3), a pair of walls 230, 240 are formed integrally with the contact cover 5 at both sides of the edges of the reinforcing member 150. The reinforcing member 150, the conductor member 130 and the terminal 120 of the outside cable 110 are connected together by a screw. Feet of the pair of walls 230, 240 may be connected to each other to give a more mechanical strength to the pair of walls. By forming the pair of walls 230, 240, it is avoided that the terminal 120 of the cable 110 is rotated around the screw when the screw is fastened.

The conductor member structure may be further modified. For example, it is possible to form the reinforcing member in a bolt-shape having a male screw. In this case, a female screw may be formed in the contact cover 5, and the reinforcing member may be screwed-in to the contact cover 5.

Advantages attained in the present invention will be summarized below. The reinforcing member 150 having a high mechanical strength is embedded in the contact cover 5, and a relatively fragile conductor member 130 extending straight in the axial direction is connected to the reinforcing member 150. Therefore, the outside cable 110 can be connected to the reinforcing member 5 with a relatively heavy screw without directly imposing a high vibration to the conductor member 130. Since the conductor member 130 extends straight in the axial direction, a process of assembling the contact cover 5 to the main body 1 can be automated. Since the foot portion of the reinforcing member 150 that is embedded in the contact cover 7 is angled and has a relatively large size, it can be avoided that a stress due to vibration concentrates to a small area in the molded body of the contact cover 5. Thus, damages in the molded resin due to creeping or fatigue can be avoided.

The contact surfaces of the extending end of the conductor member 130 and the free end portion of the reinforcing member 150 are rectangular and have a substantially same area, a contact resistance between contact surfaces can be minimized. In the structure shown in FIG. 3, after the electromagnetic switch is completed by connecting the conductor member 130 to the reinforcing member 150 with the screw 200, the outside cable 110 can be connected to the reinforcing member 150 with another screw 210. This means that the outside cable 110 can be connected separately from the process of manufacturing the electromagnetic switch, even after the starter to which the electromagnetic switch is connected is mounted on the vehicle.

In the modified form (1), the conductor member 130, the reinforcing member 150 and the outside cable 110 can be connected with a single screw. In the modified form (2), after the electromagnetic switch is completed by connected the conductor member 130 to the reinforcing member 150 via the connecting member 220, the outside cable 110 can be connected to the reinforcing member 150 separately from the process of manufacturing the electromagnetic switch. In the modified form (3), it is prevented that the terminal 120 of the outside cable 110 rotates together with the screw by the pair of walls 230, 240 integrally formed with the contact cover 5.

While the present invention has been shown and described with reference to the foregoing preferred embodiment and modified forms, it will be apparent to those skilled in the art that changes in form and detail may be made therein without departing from the scope of the invention as defined in the appended claims.

What is claimed is:

1. An electromagnetic switch to be mounted on a starter for cranking an internal combustion engine, comprising:

an excitation coil having a conductor member connecting the excitation coil to an outside cable for supplying excitation current to the excitation coil;

a plunger for driving a movable contact upon supplying the excitation current to the excitation coil;

a pair of stationary contacts adapted to be closed by the movable contact;

a contact cover covering the pair of stationary contacts; and a reinforcing member having a foot portion embedded in the contact cover and a free end portion having a flat surface extending from the contact cover, wherein:

the conductor member of the excitation coil has an end extending from the contact cover in the same direction as the free end portion of the reinforcing member;

the reinforcing member has a mechanical strength much higher than that of the conductor member;

the flat surface of the free end portion of the reinforcing member is directly connected to the extending end of the conductor member and to the outside cable to thereby establish electrical and mechanical connections therebetween;

the extending end of the conductor member and the free end portion of the reinforcing member are formed in a plate-shape and have respective contact surfaces contacting each other; and both contact surfaces are in rectangular shape and have the same surface area; and the free end portion of the reinforcing member, the extending end of the conductor member and the outside cable are overlapped and connected together with a common screw.

2. The electromagnetic switch as in claim 1, wherein:

the conductor member is led out from the contact cover through a through-hole formed in the contact cover; and the foot portion of the reinforcing member is embedded in the contact cover along the through-hole, so that the foot portion contacts the conductor member in the through-hole.

3. The electromagnetic switch as in claim 1, wherein:

the contact cover includes a pair of walls standing at positions close to both edges of the plate-shaped free end portion of the reinforcing member to prevent the outside cable connected to the free end portion from rotating relative to the free end portion.

4. An electromagnetic switch to be mounted on a starter for cranking an internal combustion engine, comprising:

an excitation coil having a conductor member connecting the excitation coil to an outside cable for supplying excitation current to the excitation coil;

a plunger for driving a movable contact upon supplying the excitation current to the excitation coil;

a pair of stationary contacts adapted to be closed by the movable contact;

a contact cover covering the pair of stationary contacts; and a reinforcing member having a foot portion embedded in the contact cover and a free end portion having a flat surface extending from the contact cover, wherein:

the conductor member of the excitation coil has an end extending from the contact cover in the same direction as the free end portion of the reinforcing member;

the reinforcing member has a mechanical strength much higher than that of the conductor member;

the flat surface of the free end portion of the reinforcing member is directly connected to the extending end of the conductor member and to the outside cable to thereby establish electrical and mechanical connections therebetween;

the extending end of the conductor member and the free end portion of the reinforcing member are formed in a plate-shape and have respective contact surfaces contacting each other;

both contact surfaces are in rectangular shape and have the same surface area;

the free end portion of the reinforcing member is overlapped with the extending end of the conductor member and connected thereto by a screw; and the free end portion of the reinforcing member is overlapped also with the outside cable and connected thereto by another screw.

5. An electromagnetic switch to be mounted on a starter for cranking an internal combustion engine, comprising:

an excitation coil having a conductor member connecting the excitation coil to an outside cable for supplying excitation current to the excitation coil;

a plunger for driving a movable contact upon supplying the excitation current to the excitation coil;

a pair of stationary contacts adapted to be closed by the movable contact;

a contact cover covering the pair of stationary contacts; and a reinforcing member having a foot portion embedded in the contact cover and a free end portion extending from the contact cover, wherein:

the conductor member of the excitation coil has an end extending from the contact cover in the same direction as the free end portion of the reinforcing member;

the reinforcing member has a mechanical strength much higher than that of the conductor member; and the free end portion of the reinforcing member is electrically and mechanically connected to the extending end of the conductor member via a connecting member, and the free end portion of the reinforcing member has a female screw hole and is connected to the outside cable with a male screw.

6. The electromagnetic switch as in claim 5, wherein:

the free end portion of the reinforcing member, the connecting member and the outside cable are connected to one another with a common screw.

7. The electromagnetic switch as in claim 5, wherein:

the free end portion of the reinforcing member is plate-shaped; and the contact cover includes a pair of walls standing at positions close to both edges of the plate-shaped free end portion of the reinforcing member to prevent the outside cable connected to the free end portion from rotating relative to the free end portion.

* * * * *